US007958992B1

(12) United States Patent
Stier

(10) Patent No.: US 7,958,992 B1
(45) Date of Patent: Jun. 14, 2011

(54) INSPECTION DOOR WITH RADIUSED COAMING FOR DUST CONTROL

(76) Inventor: Randal J. Stier, Central Square, NY (US)

( * ) Notice: Subject to any disclaimer, the term of this patent is extended or adjusted under 35 U.S.C. 154(b) by 0 days.

(21) Appl. No.: 12/949,852

(22) Filed: Nov. 19, 2010

(51) Int. Cl.
*E06B 7/16* (2006.01)
*B65G 21/00* (2006.01)

(52) U.S. Cl. ..... 198/860.4; 193/34; 49/398; 49/401; 49/402; 49/483.1

(58) Field of Classification Search ..... 193/34; 198/860.4; 49/400–402, 398; 105/377.07, 105/377.08
See application file for complete search history.

(56) References Cited

U.S. PATENT DOCUMENTS 1,789,069 A * 1/1931 Gove ..... 318/262
3,259,078 A 7/1966 Radey et al.
4,177,736 A * 12/1979 Przybylinski et al. ... 105/377.05
4,363,350 A 12/1982 Beckerer
6,827,025 B2 * 12/2004 Gaydos et al. ..... 105/377.07
7,003,850 B2 2/2006 Gaydos et al.
7,028,629 B2 4/2006 Walcome
7,735,620 B2 5/2010 Swinderman

OTHER PUBLICATIONS

Tsubaki Conveyor of America, Inc., One-Touch Inspection Door, product sheet, Summer 2010.

* cited by examiner

*Primary Examiner* — Mark A Deuble
(74) *Attorney, Agent, or Firm* — Bernhard P. Molldrem, Jr.

(57) ABSTRACT

A dust control inspection door has its door frame formed of frame elements each with a flat outer portion against the associated shroud, and with the seal flange or coaming radiused 90 degrees. The edge of the seal flange or coaming is perpendicular to the door to engage the gasket or seal bead, and is at zero degrees to the frame flat portions, so there is no angled bend line and no weak zones. The coaming is free of any horizontal surfaces on which dust may collect.

4 Claims, 3 Drawing Sheets

INSPECTION DOOR WITH RADIUSED COAMING FOR DUST CONTROL

BACKGROUND OF THE INVENTION

The invention is directed to an access door of the type that is used on an enclosure for a chute or conveyor of the type for moving grain, minerals, coal or the like. These are also sometimes called inspection doors or dust control doors. The access door (or inspection door) is provided on the cover of the chute or conveyor to permit inspection of the conveyor belt or other equipment without having to remove panels of the housing. The door is hinged onto a frame that is welded or bolted onto the cover panel, and is designed to seal against a gasket to keep the pulverized materials and dust from escaping. There is a problem in the dust containment, in that dust tends to accumulate on horizontal ledges of the frame or on the horizontal flanges of the door. In some attempted improvements, the coaming or closure flange around the opening in the frame has been angled so that a flat level ledge is avoided. However, these angled flanges or coamings have resulted in weakening of the structure because the door seal or gasket bears against the edge of the sealing flange at an angle, which eventually bends it out of alignment.

OBJECTS AND SUMMARY OF THE INVENTION

It is an object of the invention to provide an access door or inspection door for a cover or shroud for bulk-materials processing equipment, e.g., a coal conveyor or grain conveyor.

It is a more specific object to provide the inspection door with a sealing flange or coaming that surrounds the opening in the door frame, and which avoids any flat level surfaces that might collect particles, i.e., dust.

It is a further object to provide the inspection door with a sealing flange or coaming that avoids any sharp bends or angles to provide optimal strength and durability, and which will seal reliably against the door gasket or seal bead.

In accordance with an aspect of this invention, a dust-resistant inspection door is provided for an enclosure or shroud of a bulk materials handling system, such as a conveyor. The objective of the enclosure or shroud is to contain dust that is associated with the bulk materials, to prevent it from escaping into the workspace and ambient air. As is the practice, an inspection opening is provided at which the inspection door is mounted. A door frame is mounted on the enclosure and surrounds the inspection opening. The frame may be bolted or welded onto the enclosure. At an inner edge or inner perimeter of the door frame, a sealing flange or coaming extends inward (toward the center of the opening) and then out from the frame so as to extend proximally away from the enclosure. The door itself can take the form of a closure panel that extends laterally over the door frame and is at least coextensive with the opening. The door can be rectangular, but could have another geometry. A gasket or resilient dust sealing bead extends within the periphery of the closure panel, such that it meets a proximal edge of the coaming, to form a dust seal where the coaming bears against the sealing bead when the closure panel is held shut or closed. Hinges and a latch are provided to allow the door to open and close, and to keep it shut until an inspection is needed. Of course, many various means are available for releasably holding the closure panel secured shut against the door frame, but which allow the closure panel to be opened away from the door frame to permit inspection of the material handling system.

The improvement achieved here has been to form the frame elements with a flat outer portion against the cover panel, and then with the seal flange or coaming radiused 90 degrees, i.e., formed unitarily with the frame (or frame sections) as quarter cylinder. The edge of the seal flange or coaming is thus perpendicular to the door seal bead, and also the coaming or flange is at zero degrees to the flat portion where they join, so there is no angled bend line and no weak zones. Also, because the coaming or flange is round throughout, with no flat zones and no horizontal areas, the process dust does not accumulate on it. The coaming is free of any horizontal surfaces on which dust may collect. The arcuate or quarter-cylinder arch construction is particularly robust, and does not deform from continued heavy-duty use.

The gasket may take the form of a resilient seal, i.e., a D-section seal bead. The door itself is favorably rectangular with half-inch 90 degree flanges that position themselves outside the radiused coaming or seal flanges.

DETAILED DESCRIPTION OF THE PREFERRED EMBODIMENT

Figure 1:
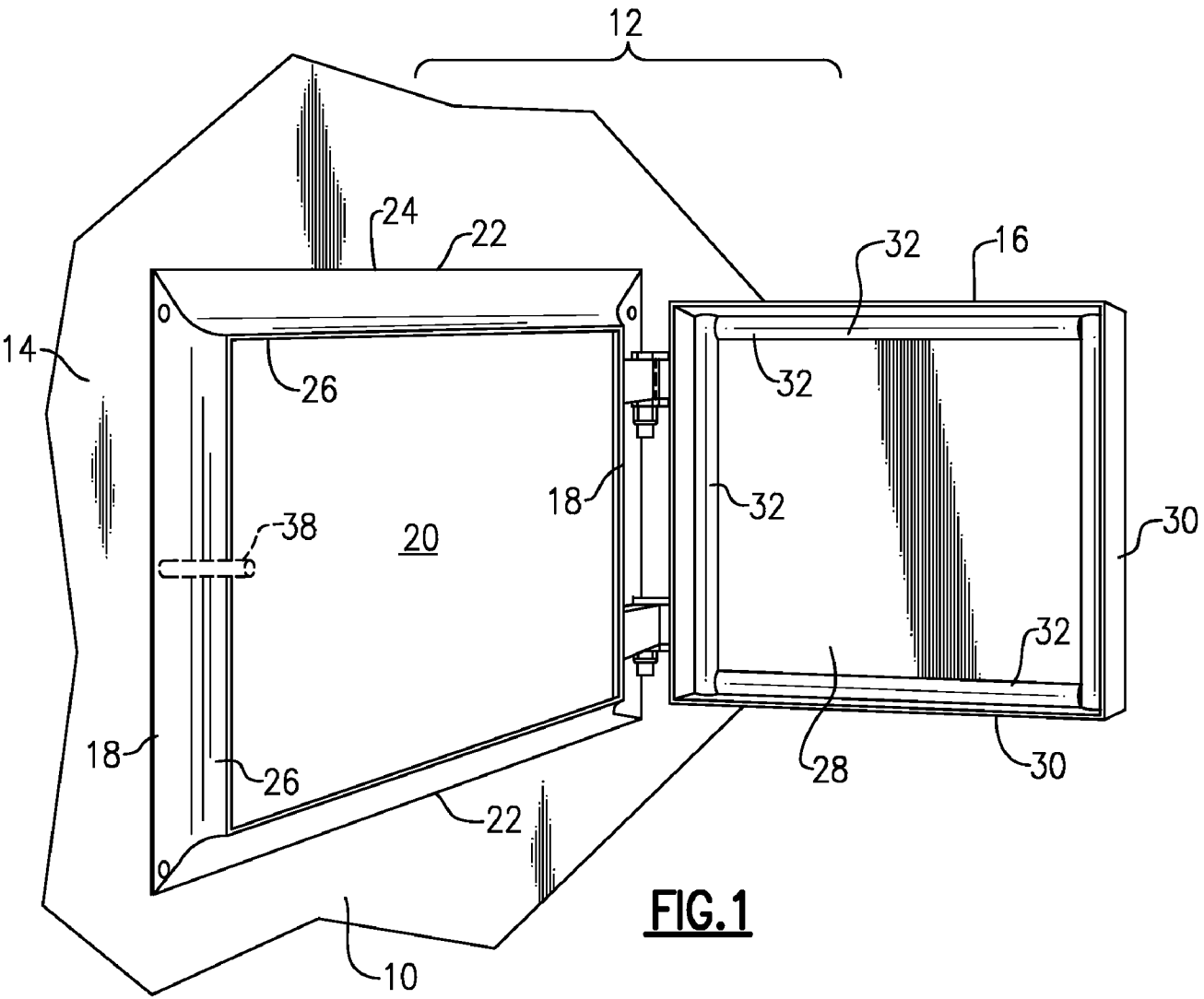
FIG. 1 is a perspective view of an inspection door assembly according to one preferred embodiment of the invention.

With reference now to the Drawing, and initially to FIG. 1, a conveyor shroud or housing 10 is provided with one or more inspection doors, which can be opened for access to conveyor machinery that is concealed behind the shroud 10. The conveyor is or may be used for handling coal, grain, cement, or any bulk material that is prone to generate dust and particulates. The shroud 10 is intended to contain these dust particles and keep them out of the workman's environment.

One inspection door assembly 12 is shown here, mounted on one wall of the conveyor shroud 10 at a square or rectangular access opening 20. The inspection door assembly 12 includes a frame 14 and a door 16 supported on the frame. The frame is bolted, riveted, or welded onto the shroud. In this embodiment, the frame 14 is formed of a pair of vertical frame members 18 and a pair of horizontal frame members 22, which have generally mitered ends for the corners of the door frame, and these frame members are fitted and welded together to form a rectangular frame unit. These are shown in more detail in FIGS. 2 to 5. Each of the frame members 18 or 22 has a generally flat outer web portion 24 and a flange or coaming portion 26 that arcs out from an inner edge of the flat web portion 24, and continuously curves in a proximal through ninety degrees, i.e., extending out and away from the access opening 20. In this embodiment, the four frame members are joined to one another at their mitered corners, such that the coaming 26 takes the form of four successive sections, one on each side, each of which is substantially a quarter-cylinder.

The inspection door 16 is formed of a flat, generally rectangular door panel 28 that overlies the frame and access opening, and has side flanges 30 that extend distally (i.e., towards the frame and shroud when the door is shut) at ninety degrees from the respective edges of the door panel 28. A gasket or gaskets 32, which here take the form of a flexible seal bead, extend around the periphery of the door panel 28. The gasket is positioned to meet the proximal inner edge of the frame flange or coaming 26 when the door is shut, forming a dust-resistant seal that prevents escape of the process dust. In other embodiments, the gasket can take on other forms or profiles, or be formed of another suitable material.

Figure 2:
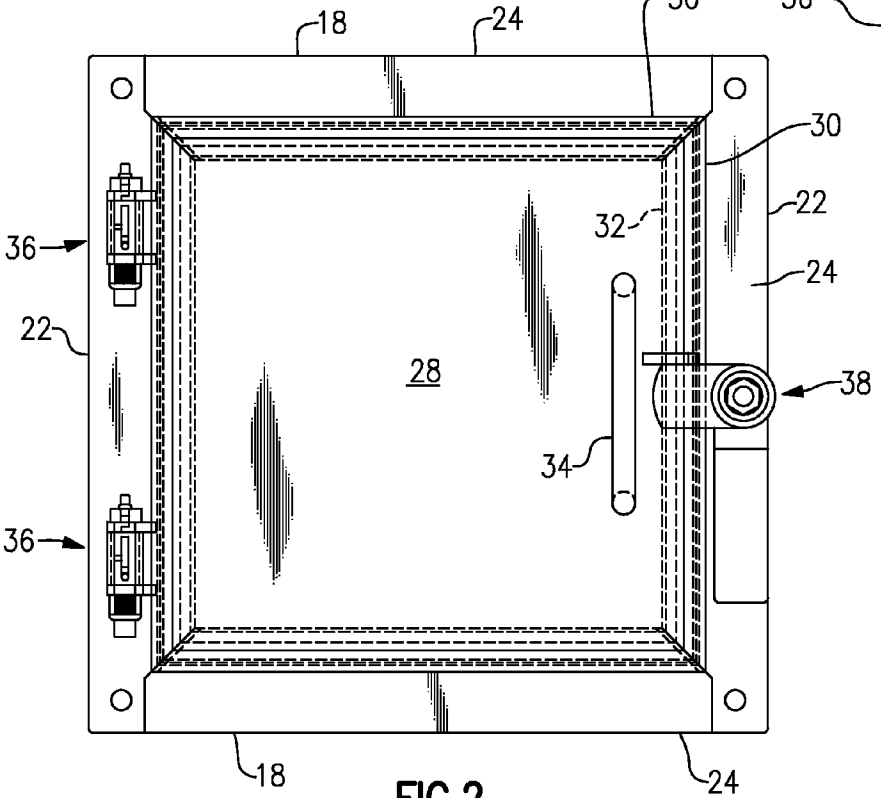
FIG. 2 is a front elevation of the inspection door assembly of this embodiment.
Figure 4:
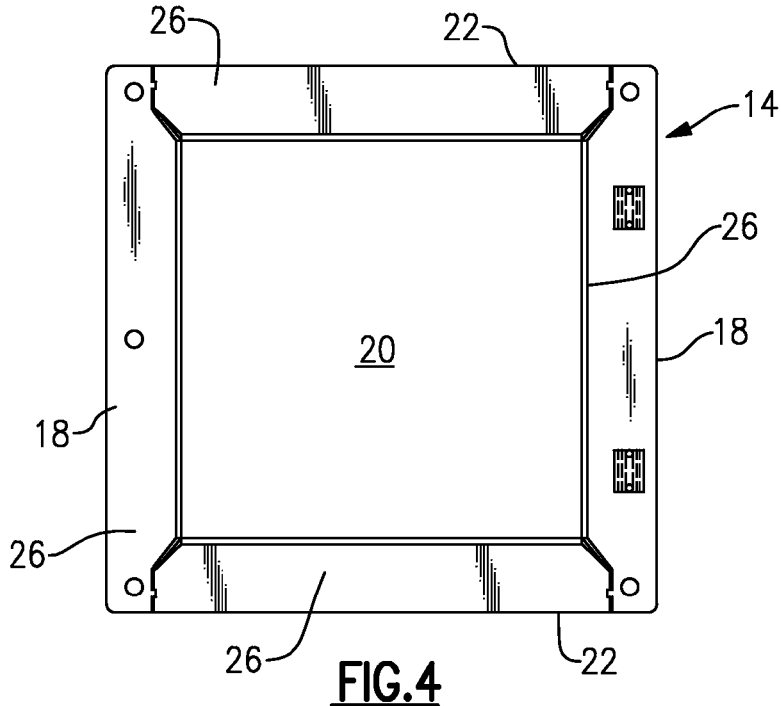
FIG. 4 is a front elevational view of the door frame thereof.
Figure 5:
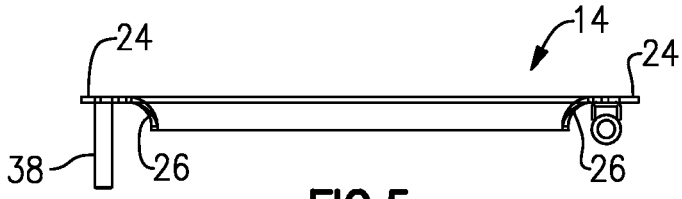
FIG. 5 is a top sectional view thereof.
Figure 6:
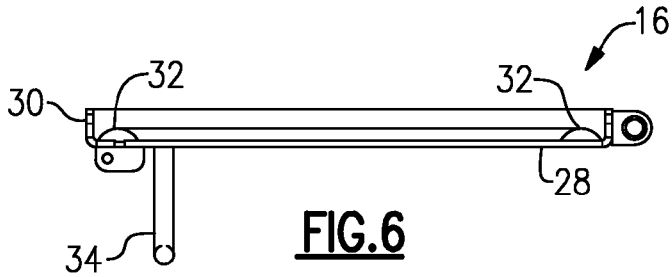
FIG. 6 is a top sectional view of the door portion thereof.

As shown in FIGS. 2 and 6, a U-shaped pull-handle 34 is affixed onto the outer surface of the door panel 28 to allow a workman to grasp and pull to open the door 16. Hinges 36 are provided affixed onto one of the vertical frame members 20 and a corresponding side flange 30 of the door. A latch member 38 is provided on the opposite frame member 20 (a center post of the latch is shown in broken line in FIG. 1), and releasably holds the access door closed, keeping the edge of the coaming 26 against the seal bead or gasket 32 and forming a dust seal. The hinges, handle, and latch can be selected from any of a number of available designs, sufficient to keep the inspection door securely closed but to permit it to be opened when an inspection is required. Here the frame 14 is shown with bolt holes or openings for attaching or mounting onto the associated conveyor shroud 10.

Figure 3:
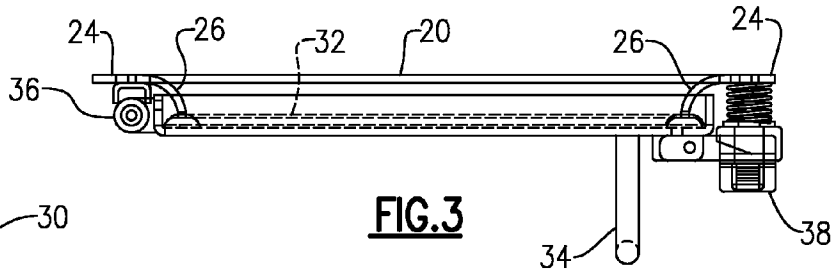
FIG. 3 is a section view thereof, from above.
Figure 3A:
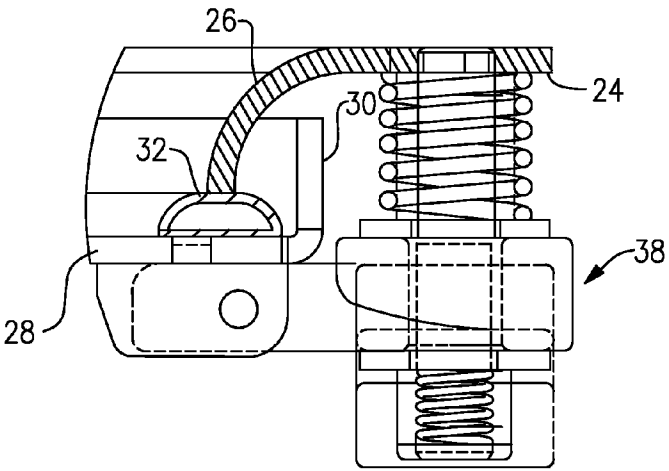
FIG. 3A is a detail view of a portion of FIG. 3, featuring the 90-degree radiused coaming mating with the D-section seal bead or gasket.

FIG. 3A shows detail of the coaming 26 and gasket or seal bead 32. The latter here has a generally D-shaped profile, and can be made of a urethane or other resilient flexible material. This gasket configuration will stand up to contact with the edge of the steel coaming 26, and will continue to maintain a dust barrier when the door is closed. As shown here, the radiused arcuate flange or coaming 26 is at a right angle to the door panel 28 at its edge, so that it contacts the seal bead 32 straight on, i.e., perpendicularly, and not at an angle. The junction of the flange 26 with the flat web portion of the respective frame member 18 or 22 is at zero degrees and flush with the flat web portion, so there is no bend line nor angulation at that point. That is, the radiused coaming flange 26 continues out in the same plane as the flat web portion 24 where the two are joined. The coaming 26 curves smoothly out in a continuous arc, with no flat surfaces and with no horizontal portions at the upper and lower horizontal frame members where dust can accumulate. Also, because the flange or coaming is a smooth, continuous curved member, with no bends, the coaming is better able to withstand stresses without deforming or changing its shape over time.

The inspection door can be made in other dimensions, and may be right- or left-hand opening configurations. Also, the door assembly may be formed with rounded or oval corners, if desired. In this embodiment, a stainless steel is preferred for the door and frame, but other materials may be employed in other embodiments, depending upon the intended application.

The above-described embodiment is offered to explain the principles of the invention, the scope of which is to be ascertained from the appended claims.

I claim:

1. In a dust-resistant inspection door for an enclosure of a bulk materials handling system, wherein the enclosure is provided with an opening at which the inspection door is mounted, comprising a door frame mounted on the enclosure and surrounding said opening, and including a coaming that protrudes from an inner perimeter of the frame and extends proximally away from the enclosure;

a closure panel extending over said door frame and at least coextensive with said opening, including a resilient dust sealing bead that extends within the periphery of said closure panel, such that a proximal edge of said coaming bears against the sealing bead when the closure panel is held in a closed position; and means for releasably holding said closure panel secured shut against the door frame, but permitting the closure panel to be opened away from the door frame to permit inspection of the material handling system;

the improvement wherein said coaming is in the form of a continuous curved flange that is flush at zero degrees with the door frame at a junction therewith and curves continuously to the proximal edge thereof so that the flange is 90 degrees to the door frame at the proximal edge where it bears against the seal bead.

2. The dust-resistant inspection door according to claim 1 wherein said coaming is in the form of successive sections, each of which is a quarter-cylinder.

3. The dust-resistant inspection door according to claim 1 wherein said coaming is free of any angular bend at its junction with the door frame.

4. The dust-resistant inspection door according to claim 1, wherein said coaming is free of any horizontal surfaces on which dust may collect.

* * * * *